US010602820B2

(12) United States Patent
Phipps

(10) Patent No.: US 10,602,820 B2
(45) Date of Patent: Mar. 31, 2020

(54) PROTECTIVE DEVICE AND METHOD FOR WRISTWATCHES AND SIMILAR ARTICLES

(71) Applicant: Simon Bradley Phipps, Hong Kong (CN)

(72) Inventor: Simon Bradley Phipps, Hong Kong (CN)

(73) Assignee: Simon Bradley Phipps, Hong Kong (CN)

( * ) Notice: Subject to any disclaimer, the term of this patent is extended or adjusted under 35 U.S.C. 154(b) by 134 days.

(21) Appl. No.: 15/501,858

(22) PCT Filed: Aug. 8, 2014

(86) PCT No.: PCT/CN2014/000754
§ 371 (c)(1),
(2) Date: Feb. 6, 2017

(87) PCT Pub. No.: WO2016/019483
PCT Pub. Date: Feb. 11, 2016

(65) Prior Publication Data
US 2017/0238665 A1 Aug. 24, 2017

(51) Int. Cl.
*A45C 11/12* (2006.01)
*A45C 11/10* (2006.01)

(52) U.S. Cl.
CPC ..... *A45C 11/12* (2013.01); *A45C 11/10* (2013.01)

(58) Field of Classification Search
CPC ..... A45C 11/12; A45C 11/10
USPC ..... 206/301, 6.1, 493, 303, 18, 70; 368/281; 224/170
See application file for complete search history.

(56) References Cited

U.S. PATENT DOCUMENTS 2,076,221 A * 4/1937 Bradbury ..... G04B 37/005 224/170
2,227,131 A * 12/1940 Friedman ..... G04B 37/005 368/281
2,249,550 A * 7/1941 Williams ..... A44C 5/00 2/16
3,061,170 A * 10/1962 Baker ..... B65D 31/04 383/109
3,437,195 A * 4/1969 Hill ..... B65D 75/54 206/226
4,387,838 A * 6/1983 Jackson ..... A41D 19/0027 2/160

(Continued)

*Primary Examiner* — Chun Hoi Cheung
(74) *Attorney, Agent, or Firm* — Vicki Norton

(57) ABSTRACT

A device and method thereof for protecting watches and similar articles is provided. The device comprises a tubular support cushion (12) having a first end (122) and a second end (124); a tubular protective sheath (14) having a first end (142) and a second end (144), wherein the first end (142) of the protective sheath is integrally connected to the first end (122) of the support cushion; wherein the support cushion (12) has a suitable thickness and size for fitting one or more articles to be protected thereon and providing support therefor; and wherein the protective sheath (14) is foldable toward the second end (124) of the support cushion to cover at least a portion of the support cushion on which the article fitted, and when the folded protective sheath is on the exterior of the device, it protects the article on the support cushion. The device provides easy, practical and secure presentation, storage and protection for the precious articles when they are not worn.

20 Claims, 8 Drawing Sheets

(56) References Cited

U.S. PATENT DOCUMENTS

| | | | | |
|---|---|---|---|---|
| 5,332,135 | A * | 7/1994 | Fletcher | G04B 37/005 224/164 |
| 6,199,730 | B1 * | 3/2001 | Chisolm | A44C 5/0053 224/164 |
| 7,120,936 | B2 * | 10/2006 | DeSantis | A41B 7/00 2/123 |
| 7,252,215 | B1 * | 8/2007 | Furnas, II | A45C 1/04 224/164 |
| 8,677,515 | B2 * | 3/2014 | Ishihara | A44C 5/0015 2/125 |
| 2004/0008613 | A1 * | 1/2004 | Beckwith | B65D 75/32 720/736 |

* cited by examiner

PROTECTIVE DEVICE AND METHOD FOR WRISTWATCHES AND SIMILAR ARTICLES

FIELD OF THE INVENTION

The invention relates to protective devices and methods for presenting, storing and safekeeping wristwatches and similar articles.

BACKGROUND OF THE INVENTION

Luxury wristwatches are typically sold in boxes which protect them during transportation, display and demonstration at point-of-sale. After the sale, however, consumers rarely if at all use such boxes for protection during daily use of the watches because the boxes are bulky and inconvenient. There are also some other after-market watch boxes. For example, there are specialist watch boxes which keep 'winding' watches when not being worn, or numerous leather box solutions with a separate removal watch cushion, or box solutions with a hole to insert the watch with no cushion. Each of these bulky or inflexible box solutions has limitations for the everyday owner of perhaps one or two luxury watches. After the sale, the watches, when not worn, are most commonly placed e.g. in the pocket or a handbag, or on desk top or in drawers without any protection. Often, for example during physical activities, a person needs to place her watch in a pocket of her garment, or a purse, which may also contain metal objects such as keys and coins and other sharp items, also without protection. The watches then suffer from appearance deterioration for example by micro-scratching of the outer surface. For luxury watches made of soft precious metals like gold, this problem is exasperated. As a result, the value of the watches decrease, and costly surface rehabilitation is needed after a period of use. The intrinsic value of the watch is also reduced over time for the owner as they become more and more used to storing their watches alongside less valuable items each day and night.

U.S. Pat. No. 4,684,264 discloses a protective overlay made of a disc of transparent high static vinyl that could be non-adhesively stuck on a wristwatch crystal to prevent scratching or chipping. Such films have also been applied to protect the rear face of watchcases. This however does not offer any protection for the watchcase sides or the bracelet. Further, such protective films are removed by the customer and cannot be re-used.

Various methods are known for packaging products under plastic, e.g. "clamshell" packing, stretch-packing method, and vacuum packing. For example, U.S. Pat. App. No. 20070223315 discloses a method for intimately wrapping the wristwatch in a close-fitting transparent protective film over a skin-wrapped plastics material. These methods, however, are not suitable for protection of the wristwatches after the point of sale to a retail customer.

There is therefore a need for a device and a method for protecting wristwatches by individual users against deterioration of their surface by scratching or otherwise when the wristwatch is not worn.

SUMMARY OF THE INVENTION

The present invention offers a practical, everyday solution to the presentation, securing, protection and storage of wristwatches or similar articles when not being used. The device of the present invention is small and flexible enough to be stored in many places such as a bedside drawer, safe, and/or used in travel, whilst keeping the articles secure on an integrated cushion within its protective sheath. The device disclosed in the present invention can be used for example for a wristwatch, jewelry, such as bracelet, bangle, necklace, ring, earring and any other object.

According to one aspect of the present invention, the device comprises a tubular support cushion having a first end and a second end. The device also comprises a tubular protective sheath having a first end and a second end. The first end of the protective sheath is integrally connected to the first end of the support cushion. The support cushion has a suitable thickness and size for fitting one or more articles to be protected thereon and providing support therefor, and the protective sheath is foldable toward the second end of the support cushion to cover at least a portion of the support cushion on which the article fitted. When the folded protective sheath is on the exterior of the device, it protects the article on the support cushion.

In some embodiments, the first end of the support cushion is an open end such that a supporting object can be snugly inserted to the support cushion through the first end. An open end of the support cushion allows a supporting object such as a user's hand to be inserted to provide stability when the user fitting the article on the support cushion.

According to another aspect of the present invention, a method is provided for protecting watches and similar articles using a device of the present invention. The method comprises: fitting one or more articles to be protected on the support cushion; folding the protective sheath toward the second end of the support cushion to cover the article on the support cushion.

In some embodiment of a method, the first end of the support cushion is an open end. The method further comprises a step of inserting a supporting object, such as a user's hand, into the support cushion through the first end to stabilize the support cushion. Then, one or more articles can be fitted on the support cushion with the supporting object inserted thereto. Optionally, the supporting object can be removed after folding the protective sheath.

Another embodiment of the present invention provides methods of making a device of the present invention. The method comprises: forming a tubular support cushion having a first end and a second end, wherein the support cushion has a suitable thickness and size for fitting one or more articles to be protected thereon and providing support therefor; forming a tubular protective sheath having a first end and a second end, wherein the protective sheath is foldable; connecting the first end of the protective sheath to the first end of the support cushion, wherein the protective sheath can be folded toward the second end of the support cushion to cover at least a portion of the support cushion where the article fitted.

Another embodiment of a method of making a device in the present invention comprises: stitching two seamless pieces of material to forming a tube having two ends, wherein a portion of the tube adjacent one end thereof containing a soft or elastic material therein defines a support cushion, and a portion of the tube adjacent the other end thereof defines a protective sheath. By such design, the material of the surface of the support cushion and the protective sheath are the same, thereby the integrated one piece device enables a simple design.

In another embodiment, the method of making a device for protecting watches and similar articles comprises: stitching two pieces of materials together containing inserted material at one end forming one face of the protective sheath and the support cushion; similarly, stitching two more pieces of materials containing inserted material at one end forming the other face of the protective sheath and the support cushion; connecting the above two faces by two more pieces of materials without or with inserted material forming the protective sheath sides and the support cushion edge to create a one-piece device, wherein the said two ends containing inserted material are at the same end of the one-piece device.

In accordance with the invention, one piece design integrates a support cushion within which there is an opening for use to enter a supporting object, such as a user's hand, and over which the wristwatch or jewelry is placed. An exterior protective sheath which is pulled up (folded) over the article once secured to protect the surface of the article being scratched. Therefore, the device of this invention provides easy, practical and secure, presentation, storage and protection for the precious articles when they are not worn. It is flexible enough to be stored in a variety of places and reinforces the intrinsic value of the watch or jewelry to the owner each day.

The above-mentioned and other features of this invention and the manner of obtaining and using them will become more apparent, and will be best understood, by reference to the following drawing and description.

BRIEF DESCRIPTION OF THE DRAWING

The accompanying drawings illustrate the invention.

DETAILED DESCRIPTION OF THE INVENTION

Figure 1A:
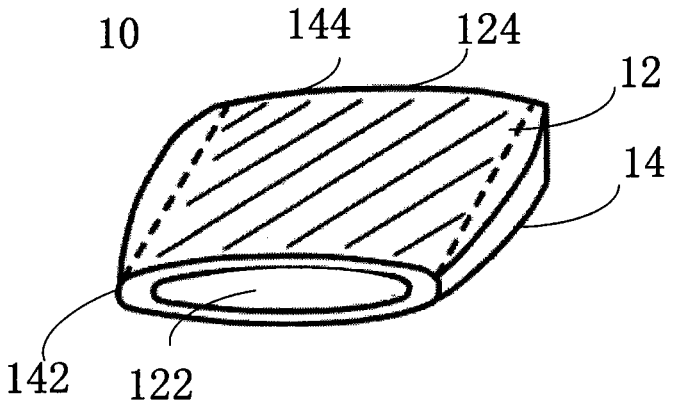
FIG. 1A-1C are perspective views illustrating some embodiments of a device for protecting watches and similar articles provided by this invention.

Referring now to FIG. 1A in detail, the device 10 for protecting watches and similar articles comprises a tubular support cushion 12 having a first end 122 and a second end 124. The device 10 comprises a tubular protective sheath 14 having a first end 142 and a second end 144. The first end of the protective sheath 142 is integrally connected to the first end of the support cushion 122. The support cushion 12 has a suitable thickness and size for fitting one or more articles to be protected thereon and providing support therefor, and the protective sheath 14 is foldable toward the second end of the support cushion 124 to cover at least a portion of the support cushion 12 on which the article fitted. When the folded protective sheath 14 is on the exterior of the device 10, it protects the article on the support cushion 12. The device with integrated cushion and sheath provides a practical and flexible storage and protection for users' day-to-day use.

In one embodiment, the first end 122 of the support cushion can be an open end such that a supporting object, such as a hand or fingers, can be snugly inserted to the support cushion 12. In this manner, inserting a user's one hand into the support cushion acts as a means of stability when the user secures the watch or similar article with the other hand. Optionally, the integrated support cushion can be without an opening for the hand or other supporting objects, as shown in FIG. 1A.

Figure 1B:
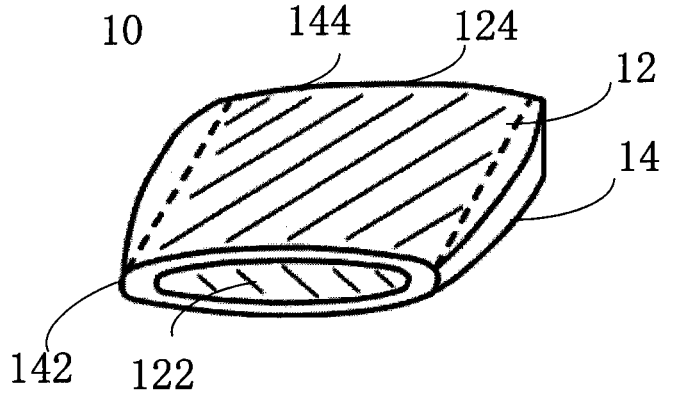

There are various ways to embody an open first end 122 for insertion of hand and similar supporting object. For example, referring to FIG. 1B, the support cushion 12 can be hollow. A hollow support cushion 12 with an open first end 122 allows the insertion of a hand and similar object into the support cushion. Thus it provides stability and assistance when the article is fitted on or taken off from the support cushion.

Figure 1C:
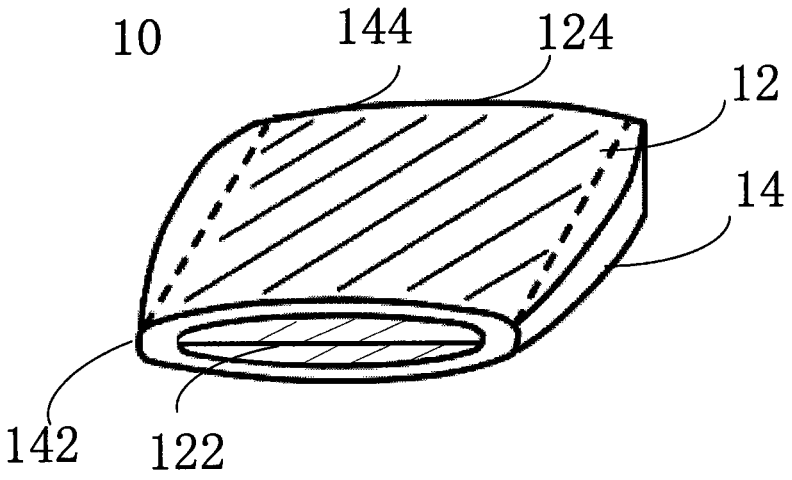

Alternatively, as illustrated in FIG. 1C, the support cushion 12 may contain a soft or elastic padding or foam inserts. The open first end 122 may be in the form of a groove or a crossing to receive a hand and similar supporting object.

It should be noted that there are various ways to achieve a hand insertion structure for the support cushion such that the hand-holdable support cushion can assistant in fitting on the articles. The above embodiments of an open first end 122 for hand insertion are illustrative but not limitative.

Figure 2:
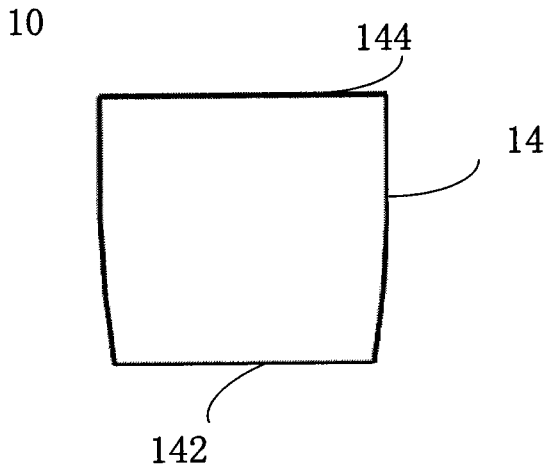
FIG. 2 is a front view illustrating an embodiment of a device provided by this invention.

The protective sheath 14 and the support cushion 12 can be the same length. Alternatively, the protective sheath 14 can also be longer or shorter than the support cushion 12. As long as the folded protective sheath 14 can cover at least the portion of the support cushion 12 where the article is fitted. If the length of the protective sheath 14 is equal to or bigger than the support cushion 12, when the protective sheath 14 is folded, the appearance of the device 10 is as shown in FIG. 2.

Figure 3:
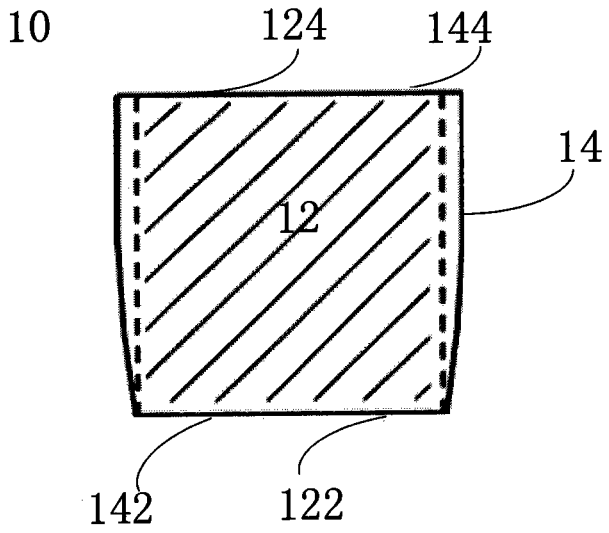
FIG. 3 is a cross-section view illustrating an embodiment of a device provided by this invention.
Figure 4:
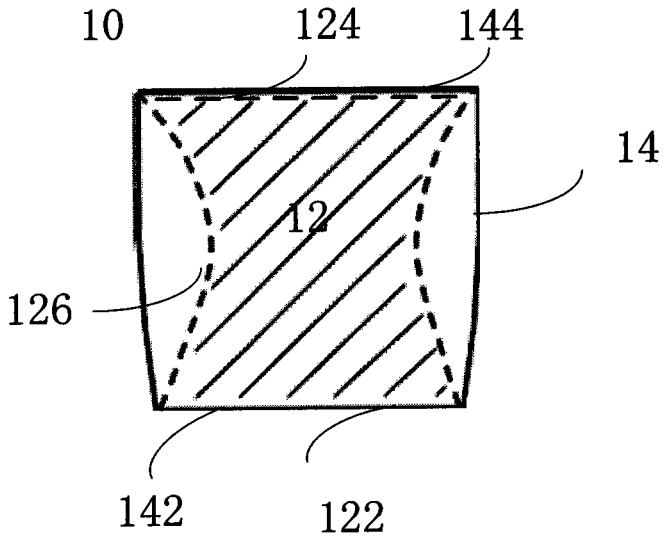
FIG. 4 is a cross-section view illustrating another embodiment of a device provided by this invention, wherein the support cushion is wider at the ends and narrower in the middle.

In one embodiment, as shown in FIG. 3, the support cushion 12 has the same width. In another embodiment, as shown in FIG. 4, the support cushion 12 may be wider at the first end 122 and the second end 124, and narrower in the middle 126. By using a structure with wider ends, when the watch or other article is fitted, it can't be easily moved around on the support cushion 12. Thus it provides better stability once the watch or other similar article is secured.

Figure 5A:
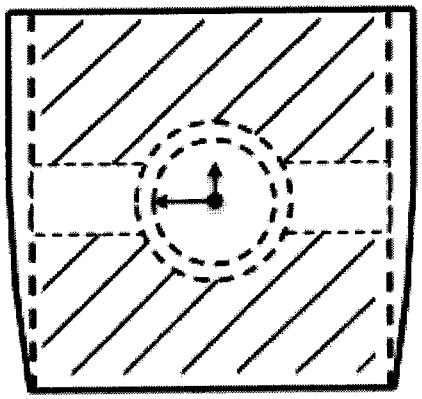
FIG. 5A-5B are a side cross-section view and a perspective view illustrating a device of this invention applied to store a watch.
Figure 5B:
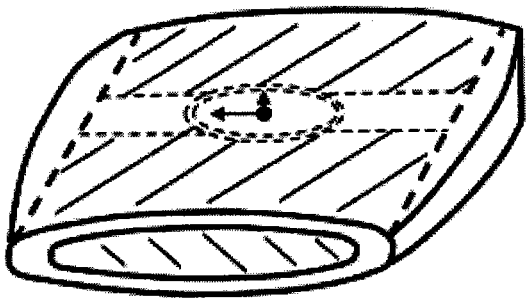

FIG. 5A-5B are a side cross-section view and a perspective view illustrating a device of this invention applied to store a watch. As shown in the two figures, the small and flexible device can be easily stored at home or carried in travel, while keeping the watch secure. It provides a practical, stable and easy storage protection suitable for day-to-day use.

Figure 6:
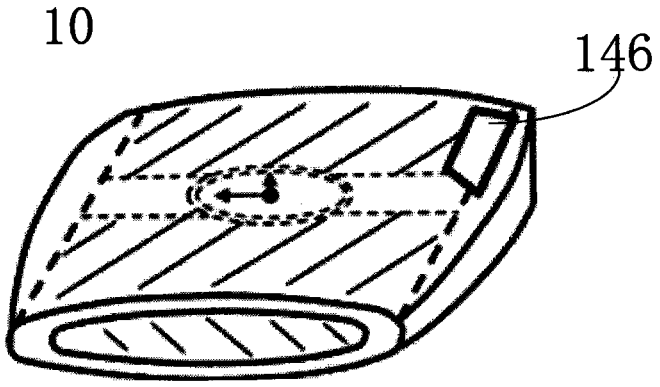
FIG. 6 is a bottom cross-section view illustrating a device of this invention applied to store a watch, wherein the device comprises a tag for identification.

The device 10 may further comprise one or more tags attached to the exterior surface of the protective sheath 14. Once the protective sheath 14 has been folded, the tag 146 is displayed on the exterior of the device 10 for identification, as shown in FIG. 6. The tag 146 can for example carrying a logo of watch or jewelry manufacturer.

In some embodiment, the surface of the protective sheath 14 can be engraved for owner personalization messages (e.g. "To Dad, with love, Your Son"). After folding the protective sheath 14, the personalized message can be displayed on the exterior of the device 10.

In another embodiment, the personalization tag can be attached on the exterior surface of the support cushion 12. Whenever the user pulls back (unfold) the protective sheath 14 and secures their articles, the tag can be displayed and reminds the users who gave it to them.

In all embodiments of the disclosure, the tag is used as a means of carrying identification information (e.g. logo) and/or personalized message integrated into the device. It can remind the owner the brand of the precious article and/or from whom the precious gift was given, which helps to keep a watch or jewelry special and reinforce the intrinsic value of the article to the owner.

Tags 146 in the above embodiments can also be a contactless readable tag, such as RFID (Radio Frequency Identification) tag attached to the surface of the protective sheath 14, the surface of the support cushion 12, or embedded in the support cushion 12. With the RFID tags, the watches, jewelry manufacturers and precious watch holders can easily track the articles with an RFID reader.

Figure 7:
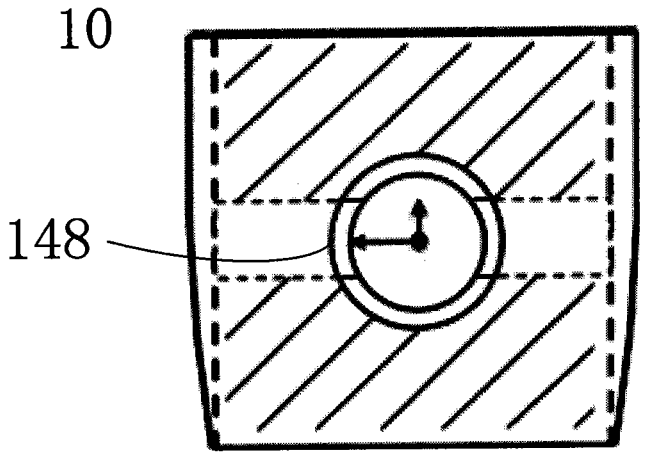
FIG. 7 is a front view illustrating another embodiment of a device of the invention, wherein a part of the protective sheath is visually transparent.

Referring to FIG. 7, in one embodiment of the device, at least part of the protective sheath 148 is visually transparent. After the protective sheath 14 has been folded, the transparent part 148 covers around the article fitted on the support cushion 12. Therefore, the article, such as the watch in FIG. 7, can be easily identified through the transparent part 148 of the protective sheath 14. Accordingly, a transparent protective sheath enables a watch or jewelry holder to quickly and easily locate and select the right pieces. Another benefit of a transparent part of the protective sheath 148 is providing an easy way to observe the status of the article storied in the device 10. For example, a mechanical watch placed in the device 10 may stop after a few days without being wound. By using the transparent design for the protective sheath 14, watch holders can easily identify the operation of the mechanical watch, and accordingly wind the spring periodically. A transparent part of the protective sheath also provides some additional aesthetic elements for the device 10. The size, form, and materials of transparent part may be varied.

Figure 9:
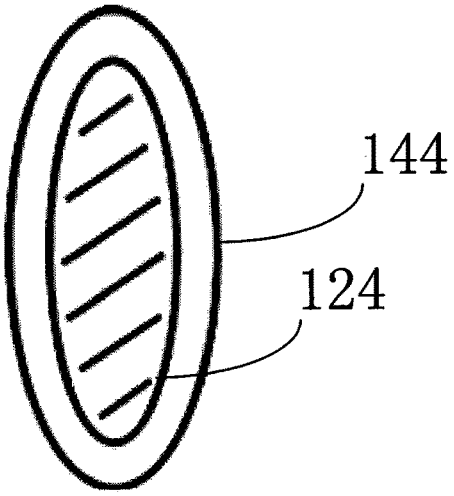
FIG. 9 is an aerial view illustrating one embodiment of a device, showing the integrated support cushion within the protective sheath, wherein the opening at the second end of the protective sheath is unfastened and the device is without watch.

Turing to FIG. 9, FIG. 9 is an aerial view of device showing the integrated support cushion 12 within the protective sheath 14 after the protective sheath 14 being folded. As shown in FIG. 9, there is an opening between the second end of the protective sheath 144 and the second end of the support cushion 124. To prevent the article secured inside from slipping out of the device 10 from the opening, accordingly, the device 10 in some embodiment can further comprise a secure means 16 adjacent the second end of the protective sheath 144. The secure means 16 for example may comprise at least one fastener adjacent the second end of the protective sheath. The fastener can be operated to close at least a portion of the opening at the second end of the protective sheath 144.

Figure 8:
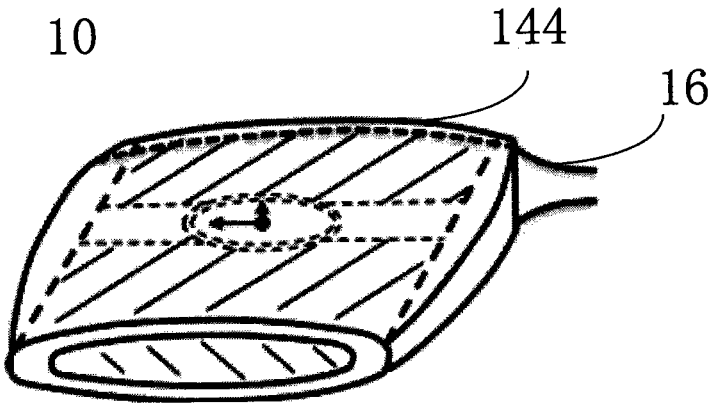
FIG. 8 is a front view illustrating another embodiment of a device of the invention, wherein the device comprises a secure means adjacent the second end of the protective sheath.

As shown in FIG. 8, the secure means 16 can be a drawstring. The drawstring can be drawn to close at least a portion of the opening at the second end of the protective sheath 144. For specifically, a drawstring can be a string, cord, or rope used to tighten or tie closed the opening of the second end 144.

Figure 10:
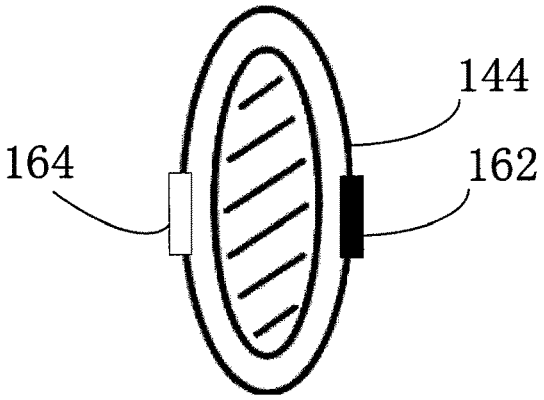
FIG. 10 is an aerial view illustrating one embodiment of a device, wherein the device comprises one fastener with two sides and each side of the fastener is respectively adjacent each side the second end of the protective sheath.

In one embodiment, the secure means 16 may comprise at least one fastener with two sides 162 and 164, such as hook-loop stripes as showing in FIG. 10. Each side of the fastener is respectively adjacent the second end of the protective sheath 144. When the two sides are pressed together, they close a portion of the opening at the second end of the protective sheath 144, which prevents the article inside from slipping out.

Additionally, taking in conjunction with one embodiment described above, a personalized tag can be attached at the end of the string of the drawstring. The secure means 16 can also be in any other forms that have magnetic or mechanical locking features.

Figure 11:
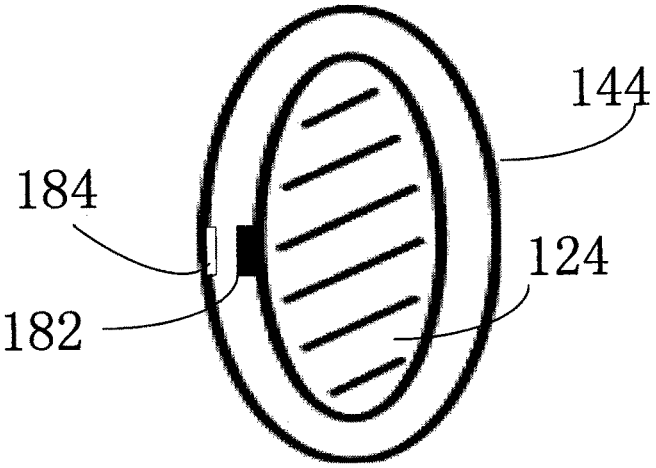
FIG. 11 is an aerial view illustrating one embodiment of a device, wherein the device comprises one fastener with two sides and each side of the fastener is respectively adjacent the second end of the protective sheath and the second end of the support cushion.

In some embodiment of the device, the secure means 16 may comprise at least one fastener with two sides. Each side of the fastener is respectively adjacent the second end of the protective sheath 144 and the second end of the support cushion 124. As another example, as illustrated in FIG. 11, one side of the fastener 184 is attached to the exterior surface and adjacent the second end of the protective sheath 144. The other one side of the fastener 182 is attached to the exterior surface of the support cushion 12 and adjacent the second end of the support cushion 124. After the protective sheath 144 being folded to cover the article inside, the side 184 is turned to the interior surface of the protective sheath 144, and the side 184 and the side 182 can be coupled to close at least a portion of the opening between the second end of the protective sheath 144 and the second end of the support cushion 124.

The fastener can include various components, such as zipper, snap fastener, button, buckle or hook-loop fastener and the like.

The protective sheath 14 and the support cushion 12 can be made of a vast array of materials. The material of the protective sheath 14 and/or material of support cushion 12 may or may not be elastic material, in whole or in part.

The support cushion 12 may be soft and spongy, and can be adapted to fit the articles to be protected. For example, the material of the support cushion 12 can be traditional foam, memory foam, latex, sponge, neoprene, leather, fabrics or any combinations thereof. The support cushion 12 may be constructed of internally, and it may also be externally finished, with different materials. For example, a neoprene version support cushion has a foam cushion over-laid with neoprene. Another example, the leather version of the support cushion has a foam cushion which has a leather outer stitched around it, so both the cushion and sheath can be of similar quality materials. The material of the protective sheath 14 can be leather, neoprene, or fabrics or any combinations thereof. The fabrics can be cotton, canvas, denim, silk, plastics, rubber, nylon or any combinations thereof. It is understood that the above materials are not limitative.

According to another aspect of the present invention, some embodiment provides a method for protecting watches and similar articles using a device of the present invention. The method comprises: fitting one or more articles to be protected on the support cushion; folding the protective sheath toward the second end of the support cushion to cover the article on the support cushion.

Figure 12A:
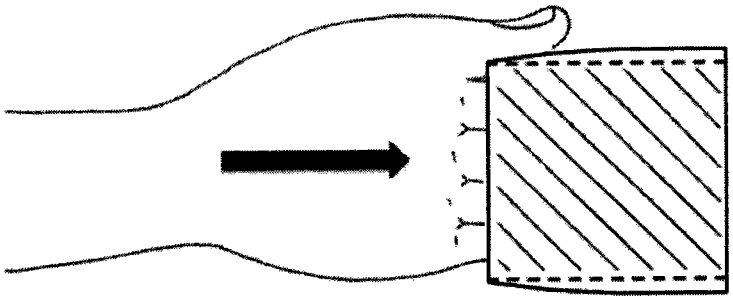
FIG. 12A-12F illustrate steps in some embodiments of the method provided by the invention to store and secure watches and similar articles.

In some embodiments, the first end of the support cushion is an open end. The method further comprises inserting a supporting object, such as a hand or fingers, into the support cushion through the first end thereof (FIG. 12A). As described above, the hand insertion can help to stabilize the support cushion. Then, the user can fit one or more articles to be protected on the support cushion with the supporting object inserted thereto (FIG. 12C), and then fold the protective sheath toward the second end of the support cushion (FIG. 12D) to cover the article on the support cushion (FIG. 12E). Optionally the user may remove the supporting object (FIG. 12F).

Figure 12B:
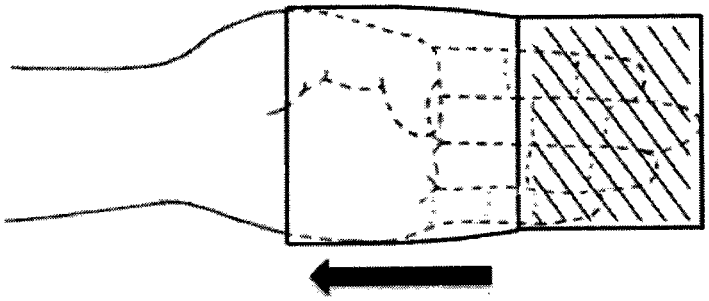
Figure 12C:
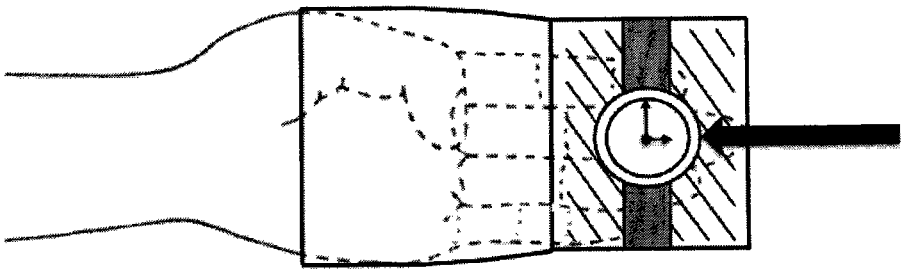
Figure 12D:
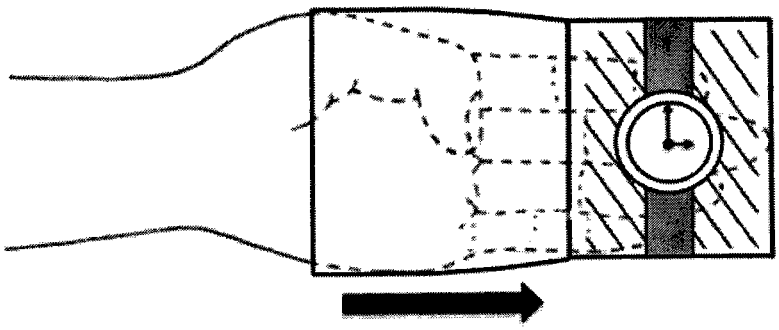
Figure 12E:
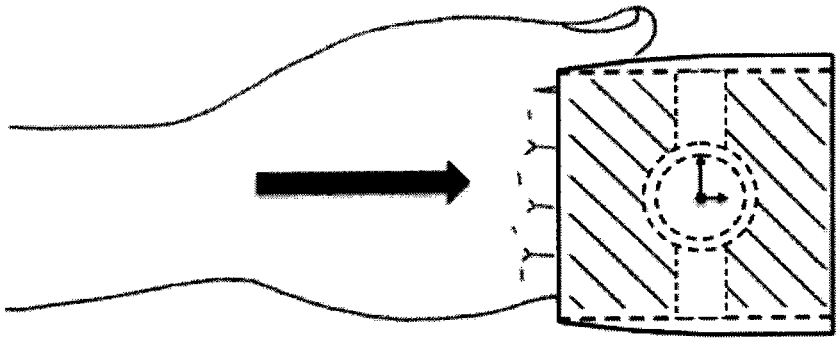
Figure 12F:
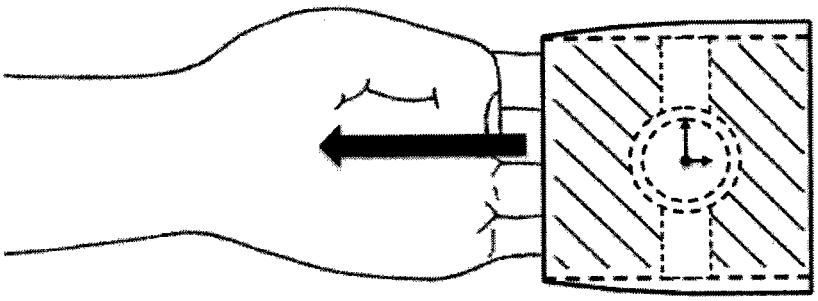

In some embodiment of the method, the method may further comprise pulling back or unfolding the protective sheath to expose the support cushion before fitting one or more articles to be protected thereon, as shown in FIG. 12B.

In some embodiment of the method, the device further comprises a secure means adjacent the second end of the protective sheath. The method further comprises operating the secure means, such as zipping up a zipper or tightening a drawstring, to prevent the article from slipping out once secured.

According to another aspect of the present invention, some embodiment provides a method of making a device of the present invention. The method comprises: forming a tubular support cushion having a first end and a second end, wherein the support cushion has a suitable thickness and size for fitting one or more articles to be protected thereon and providing support therefor; forming a tubular protective sheath having a first end and a second end, wherein the protective sheath is foldable; connecting the first end of the protective sheath to the first end of the support cushion, wherein the protective sheath can be folded toward the second end of the support cushion to cover at least a portion of the support cushion where the article fitted.

In some embodiment, forming a tubular support cushion having a first end and a second end comprises forming the support cushion having an open first end such that a supporting object can be snugly inserted thereto.

Figure 13:
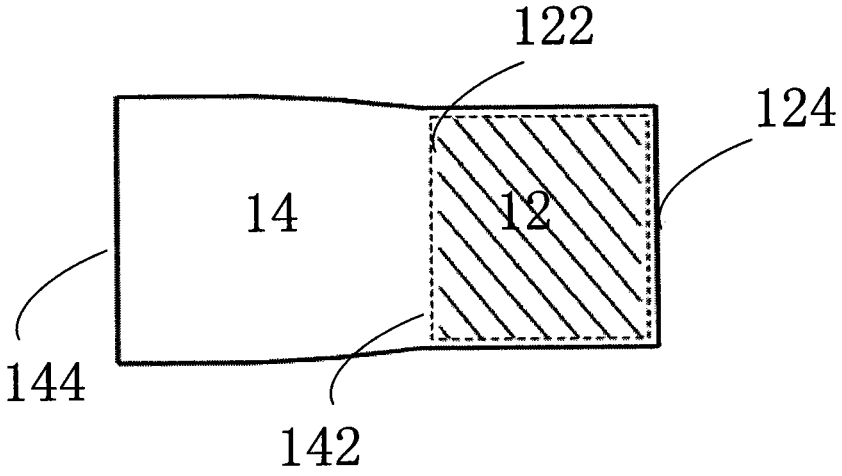
FIG. 13 a side cross-section view illustrating a device produced by a method of this invention, wherein the device is formed by a one piece-design of sheath and exterior of cushion.

Turning now to a more detailed description of a one piece-design method to make a device provided in this disclosure. Referring to FIG. 13, as shown in a cross-sectional view of an unfolded device, the method of making a device for protecting watches and similar articles comprises: stitching two seamless pieces of material to form a tube-like shape having two ends, one open and one closed, wherein a portion of the tube adjacent one end thereof containing a soft material therein defines a support cushion 12, and a portion of the tube adjacent the other end thereof defines a protective sheath 14. The support cushion 12 has a first end 122 and a second end 124, and has a suitable thickness and size for fitting one or more articles to be protected thereon and providing support therefor. The protective sheath 14 has a first end 142 and a second end 144, and the protective sheath 144 can be folded toward the second end 124 of the support cushion to cover at least a portion of the support cushion where the article is fitted. In this embodiment, by stitching two pieces of materials to form a tubular device and inserting material, such as foam, at one end to form the support cushion 12, the outer material of the support cushion 12 containing inserted material, is the same materials as the outer and inner materials of the protective sheath 14, and it also provides a simpler way to manufacture the device.

In another embodiment of the method of making a device for protecting watches and similar articles, it comprises: stitching two pieces of materials together containing inserted material such as foam at one end forming one face of the protective sheath and the support cushion; similarly, stitching two more pieces of materials containing inserted material at one end forming the other face of the protective sheath and the support cushion; connecting the above two faces by two more pieces of materials without (or with) inserted material forming the protective sheath sides and support cushion edge to create a one-piece device provided by the present invention, wherein the two ends containing inserted material are at the same end of the one-piece device. The materials of the pieces could be various, such as leather or fabric. As illustrated in the above embodiment, the outer and inner materials of the support cushion 12, containing inserted material, to form the supporting shape and nature of the cushion, can be made of the same materials as the protective sheath 14. They are two seamless pieces of material stitched together, forming the inner and outer materials of one face or one side of the device, thereby enabling a simple design. In the illustrated embodiment, separate materials for the support cushion outers and the protective sheath can also be used, and then be joined with stitching or other means. The way the seams are stitched or otherwise joined, plus the additional thickness of the inserted foam if so incorporated, then creates the product shape and prevents the sheath from travelling up beyond the cushion.

To integrate the support cushion and the protective sheath into one piece as in the manner described in the above embodiments, the manufacturing may involve side seams and depend on materials.

In some embodiment of the method, in the step of forming a tubular support cushion having a first end and a second end, a tubular support cushion is formed being wider at two ends and narrower in the middle.

In some embodiment of the method, the method further comprises forming a secure means adjacent the second end of the protective sheath to prevent the article from slipping out. The secure means may comprise at least one fastener, drawstring and the like.

In some embodiment of the method, forming a secure means comprises attaching one side of the fastener adjacent the second end of the protective sheath, and attaching the other side of fastener adjacent the second end of the support cushion. Thus the fastener can be operated to close at least a portion of the opening between the second end of the protective sheath and the second end of the support cushion.

In some embodiment of the method, the fastener may comprise zipper, snap fastener, button, buckle, hook-loop fastener and the like.

In some embodiment of the method, the method further comprises attaching one or more tags attached to the surface of the protective sheath, the surface of the support cushion, the secure means, or any combinations thereof. The tags can be displayed on the exterior of the device for identification or be shown to users when using the device.

The present invention integrates support cushion and protective sheath into one device, which provides practical and suitable daily, presentation, storage and protection of wristwatches and other valuable jewelries.

It is understood that examples and embodiments described herein are for illustrative purpose only and that various modifications or changes in light thereof will be suggested to persons skilled in the art and are to be included within the spirit and purview of this application and scope of the appended claims.

One or more features from any embodiment maybe combined with one or more features of any other embodiment without departing from the scope of the disclosure. The above description is illustrative and is not restrictive. Many variations of the invention will become apparent to those skilled in the art upon review of the disclosure. The scope of the invention should, therefore, be determined not with reference to the above description, but instead should be determined with reference to the claims along with their full scope or equivalents.

What is claimed:

1. A device for protecting watches and similar articles comprising:

a support cushion having a first end and a second end; and a tubular protective sheath having a first end and a second end, wherein the first end of the protective sheath is integrally connected to the first end of the support cushion, wherein the support cushion has a suitable thickness and size for fitting one or more articles to be protected thereon and providing support therefor, wherein the protective sheath is foldable toward the second end of the support cushion to cover at least a portion of the support cushion on which the article fitted, and when the folded protective sheath is on the exterior of the device, the protective sheath protects the article on the support cushion, and wherein both the first end and the second end of the support cushion are closed ends.

2. The device of claim 1, wherein the support cushion has wider ends and is narrower in the middle.

3. The device of claim 1, further comprises:

a secure means adjacent the second end of the protective sheath to prevent the article from slipping out once the article fitted on.

4. The device of claim 3, wherein the secure means comprises at least one fastener or drawstring adjacent the second end of the protective sheath, and the fastener or drawstring can be operated to close at least a portion of the opening at the second end of the protective sheath.

5. The device of claim 1, further comprises:

a secure means to prevent the article from slipping out once the article fitted on, wherein the secure means includes at least one fastener with two sides, and wherein each side of the fastener is respectively adjacent the second end of the protective sheath and the second end of the support cushion, and wherein the two sides can be operated to close at least a portion of the opening between the second end of the protective sheath and the second end of the support cushion.

6. The device of claim 4, wherein the fastener comprises zipper, snap fastener, button, buckle or hook-loop fastener.

7. The device of claim 3, further comprising:

one or more tags attached to the surface of the protective sheath, the support cushion, the secure means, or any combinations thereof, wherein the tag is used as a means of carrying identification information and/or personalized message.

8. The device of claim 7, wherein the tag comprises a contact-less readable tag.

9. The device of claim 1, further comprising:

one or more tags attached to the exterior surface of the protective sheath, wherein once the protective sheath has been folded, the tag is shown on the exterior of the device for identification.

10. The device of claim 1, wherein at least a part of the protective sheath is visually transparent, and wherein the transparent part of the protective sheath covers the portion of the support cushion on which the article is fitted once the protective sheath is folded.

11. The device of claim 1, wherein the material of the protective sheath and or material of support cushion comprises elastic material, in whole or in part.

12. The device of claim 1, wherein the material of the support cushion comprises traditional foam, memory foam, latex, sponge, neoprene, leather, fabrics or any combinations thereof.

13. The device of claim 1, wherein the material of the protective sheath comprises leather, neoprene, fabrics or any combinations thereof.

14. The device of claim 13, wherein the fabrics comprises cotton, canvas, denim, silk, plastics, rubber, nylon or any combinations thereof.

15. An apparatus, comprising:

a wearable article;

a support cushion having a first end and a second end; and a tubular protective sheath having a first end and a second end, wherein the first end of the protective sheath is integrally connected to the first end of the support cushion, wherein the support cushion has a suitable thickness and size for fitting the wearable article to be protected thereon and providing support therefor, wherein the protective sheath is foldable toward the second end of the support cushion to cover at least a portion of the support cushion on which the wearable article fitted, and when the folded protective sheath is on the exterior of the apparatus, the protective sheath protects the wearable article on the support cushion, wherein the second end of the support cushion is a closed end, and wherein the first end of the support cushion is an open end such that an object can be snugly inserted thereto through the first end of the support cushion for supporting the wearable article on the support cushion when the wearable article is not worn.

16. The apparatus of claim 15, wherein the support cushion is hollow.

17. An apparatus, comprising:

a wearable article, a support cushion having a first end and a second end;

a tubular protective sheath having a first end and a second end, wherein the first end of the protective sheath is integrally connected to the first end of the support cushion; and a secure means comprising at least one drawstring adjacent the second end of the protective sheath for preventing the wearable article from slipping out once the wearable article fitted on, wherein the support cushion has a suitable thickness and size for fitting the wearable article-to be protected thereon and providing support therefor, wherein the protective sheath is foldable toward the second end of the support cushion to cover an entirety of the support cushion on which the wearable article fitted, and when the folded protective sheath is on the exterior of the device, the protective sheath protects the wearable article on the support cushion, and wherein at least one end of the support cushion is a closed end.

18. The apparatus of claim 17, wherein the support cushion and the protective sheath are made of different materials.

19. The apparatus of claim 17, wherein the protective sheath forms a first tubular shape when being unfolded and forms a second tubular shape when being folded.

20. The apparatus of claim 19, further comprising at least one tag attached to the protective sheath, wherein:

when the protective sheath is unfolded, the at least one tag is on the interior of the first tubular shape; and when the protective sheath is folded, the at least one tag is on the exterior of the second tubular shape.

* * * * *